US005609304A

United States Patent [19]

Sasao

[11] Patent Number: 5,609,304

[45] Date of Patent: Mar. 11, 1997

[54] ELECTROMAGNETIC TYPE FUEL INJECTION VALVE

[75] Inventor: Isamu Sasao, Kakuda, Japan

[73] Assignee: Keihin Seiki Manufacturing Co., Ltd., Japan

[21] Appl. No.: 366,412

[22] Filed: Dec. 29, 1994

[30] Foreign Application Priority Data

Dec. 29, 1993 [JP] Japan ..... 5-350696

[51] Int. Cl.[6] ..... F02M 51/06

[52] U.S. Cl. ..... 239/585.4

[58] Field of Search ..... 239/585.1, 585.4, 239/585.5

[56] References Cited

U.S. PATENT DOCUMENTS

| | | | |
|---|---|---|---|
| 4,651,926 | 3/1987 | Sasao et al. | 239/585.4 X |
| 4,687,142 | 8/1987 | Sasao et al. | 239/585.5 X |
| 4,688,312 | 8/1987 | Sasao et al. | 239/585.5 X |
| 4,934,605 | 6/1990 | Hans et al. | 239/585.4 |

FOREIGN PATENT DOCUMENTS 3-35256 4/1991 Japan .

*Primary Examiner*—Josie Ballato

*Attorney, Agent, or Firm*—Cushman Darby & Cushman IP Group of Pillsbury Madison & Sutro, LLP

[57] ABSTRACT

Disclosed is an improvement of electromagnetic type fuel injection valve comprising: a cylindrical housing having a stationary core therein; an annular yoke positioned in the vicinity of the opening end of the housing; a coil positioned in the space defined by the housing, the stationary core and the yoke; a valve seat piece having a needle valve put therein, the valve seat piece being positioned ahead of the yoke, and comprising a valve seat and a fuel metering-and-injecting aperture consecutive to the valve seat to be opened and closed by the front end of the needle valve; and a movable plunger integrally connected to the rear end of the needle valve, opposing the end of the stationary core. The fuel injection valve is designed according to the present invention so that the flow rate at which the fuel is injected from the fuel injection valve when fully opened is 20 L/H with the fuel metering-and-injecting aperture having a maximum effective injection area of 0.3 $mm^2$, and that the product of L×D ranges from 1.8 $cm^3$ to 3.6 $cm^3$, where L stands for the longitudinal length of the magnetic path formed by the housing and the yoke, and D stands for the diameter crossing the longitudinal length L.

6 Claims, 5 Drawing Sheets

ELECTROMAGNETIC TYPE FUEL INJECTION VALVE

BACKGROUND OF THE INVENTION

1. Field of the Invention

The present invention relates to an electromagnetic type fuel injection valve. An associated fuel pump forces fuel into the electromagnetic type fuel injection valve, which permits the injecting of the fuel toward an associated suction tube, which is connected to a gasoline engine.

2. Description of the Prior Art

An electromagnetic type fuel injection valve disclosed in Japanese Utility Model Application Laid-Open No. 3-35256, comprises: a cylindrical housing having a stationary core extending from its bottom toward its opening end; an apertured valve seat piece having a fuel metering-and-injecting aperture, said valve seat piece being fixed to the terminal engagement portion of the housing; a flat valve situated between the lower end of the stationary core and the fuel metering-and-injecting aperture to open and close the aperture; and an electric coil positioned in the annular space defined between the outer circumference of the stationary core and the inner circumference of the housing.

When an electric current is made to flow in the electric coil, the flat valve is magnetically attracted to the lower end of the stationary core, thereby opening the fuel metering-and-injecting aperture.

Then, the pumped fuel flows into the annular space defined between the inner circumference of the housing and the outer circumference of the coil, and then the fuel flows from the annular space to the fuel metering-and-injecting aperture to inject to the suction tube of the gasoline engine.

Thus, a desired amount of fuel flows to the suction tube of the gasoline engine, and then, the remaining amount of fuel in the annular space is allowed to return to the fuel tank via a fuel-return path, which opens on the opposite side of the housing. The fuel injection valve which permits the fuel to flow from the outer circumference of the housing to the annular space inside of the housing is called "Side-Feeding Type".

Advantageously the use of flat valve permits reduction of the longitudinal size of the whole device. Also advantageously, no fuel-feeding through hole is made in the stationary core, thus providing an increased cross area for permitting an increased amount of magnetic flux to pass therethrough. For these reasons side-feeding, electromagnetic type fuel injection valves can be designed to be compact.

As described above, the remaining amount of fuel is made to return from the annular space to the fuel tank via the fuel-return path for reuse after injection. This fuel circulating is continued during the running operation of the gasoline engine.

The returning fuel flows around the outer circumference of the coil so that it may be heated by the heat generated in the coil when an electric current flows therein. As a result the temperature of the returning fuel rises.

Thus, the temperature of the fuel in the fuel tank rises gradually until the fuel vapor appears in the fuel tank. This does not favor the evaporation preventing rule, which prescribes the inhibiting of the releasing of fuel evaporation into the surrounding circumference.

An electromagnetic type fuel injection valve disclosed in Japanese Patent Application Laid-Open No. 61-70166 is called "Fuel Ejection Valve of Top-Feeding Type", in which fuel is made to flow down in the longitudinal fuel channel of the stationary core, and flow along the needle valve, finally injecting from the fuel metering-and-injecting aperture of the valve seat. Thus, a desired amount of fuel flows to the suction tube of the gasoline engine. No fuel is circulated and heated as in the side-feeding type valve, and therefore, the fuel injection valve of "Top-Feeding Type" is free of the temperature rise of the fuel in the fuel tank.

Disadvantageously, this type of fuel injection valve has an increased longitudinal length, thus reducing the freedom with which it can be mounted to the machine. Particularly such a fuel injection valve is difficult to be mounted to a multi-suction type of engine comprising a single cylinder having a plurality of suction valves fixed thereto.

SUMMARY OF THE INVENTION

One object of the present invention is to provide an improved topfeeding, electromagnetic type fuel injection valve which has a reduced overall size, still ensuring satisfaction of the evaporation preventing rule.

To attain this object an electromagnetic type fuel injection valve comprising: a cylindrical housing having a stationary core extending from its bottom toward its opening end; an annular yoke positioned in the vicinity of the opening end of the housing, magnetically coupling with the housing; a coil positioned in the space defined by the housing the stationary core and the yoke; a valve seat piece having a needle valve put therein, the valve seat piece being positioned ahead of the yoke, and comprising a valve seat and a fuel metering-and-injecting aperture consecutive to the valve seat to be opened and closed by the tip shoulder portion of the needle valve; and a movable plunger integrally connected to the rear end of the needle valve, opposing the end of the stationary core, is improved according to the present invention in that: the flow rate at which the fuel is injected from the fuel injection valve when fully opened is 20 L/H with the fuel metering-and-injecting aperture 9D having a maximum effective injection area of 0.3 $mm^2$; and the product of the longitudinal length L of the magnetic path A formed by the housing 1 and the yoke 7 and the diameter D crossing the longitudinal length L ranges from 1.8 $cm^3$ to 3.6 $cm^3$.

With this arrangement the longitudinal length of the injection valve can be substantially reduced without causing any adverse effects, and it can be fixed to a multi-suction gasoline engine with ease.

According to another aspect of the present invention the needle valve comprises an integral connection of a valve end, a guide rod and a plunger, the integral connection being made in a single unit piece, the valve end being adapted to open and close the fuel metering-and-injecting aperture of the valve seat, the guide rod being fitted in the guide hole of the valve seat piece, and the guide rod having fuel channels formed on its outer circumference to allow the fuel to flow down toward the valve seat, and the plunger opposing to the end of the stationary core. This arrangement makes the longitudinal size even shorter.

According to still another aspect of the present invention the valve seat piece has an annular enlargement to be fitted in and fixedly caught by the terminal engagement portion of the housing, and the valve seat piece has a guide hole extending through its full length from the rear end surface to the valve seat.

Also, this arrangement makes the longitudinal size even shorter.

Other objects and advantages of the present invention will be understood from the following description of preferred embodiments of the present invention, which are shown in the accompanying drawings.

DESCRIPTION OF PREFERRED EMBODIMENTS

Figure 1:
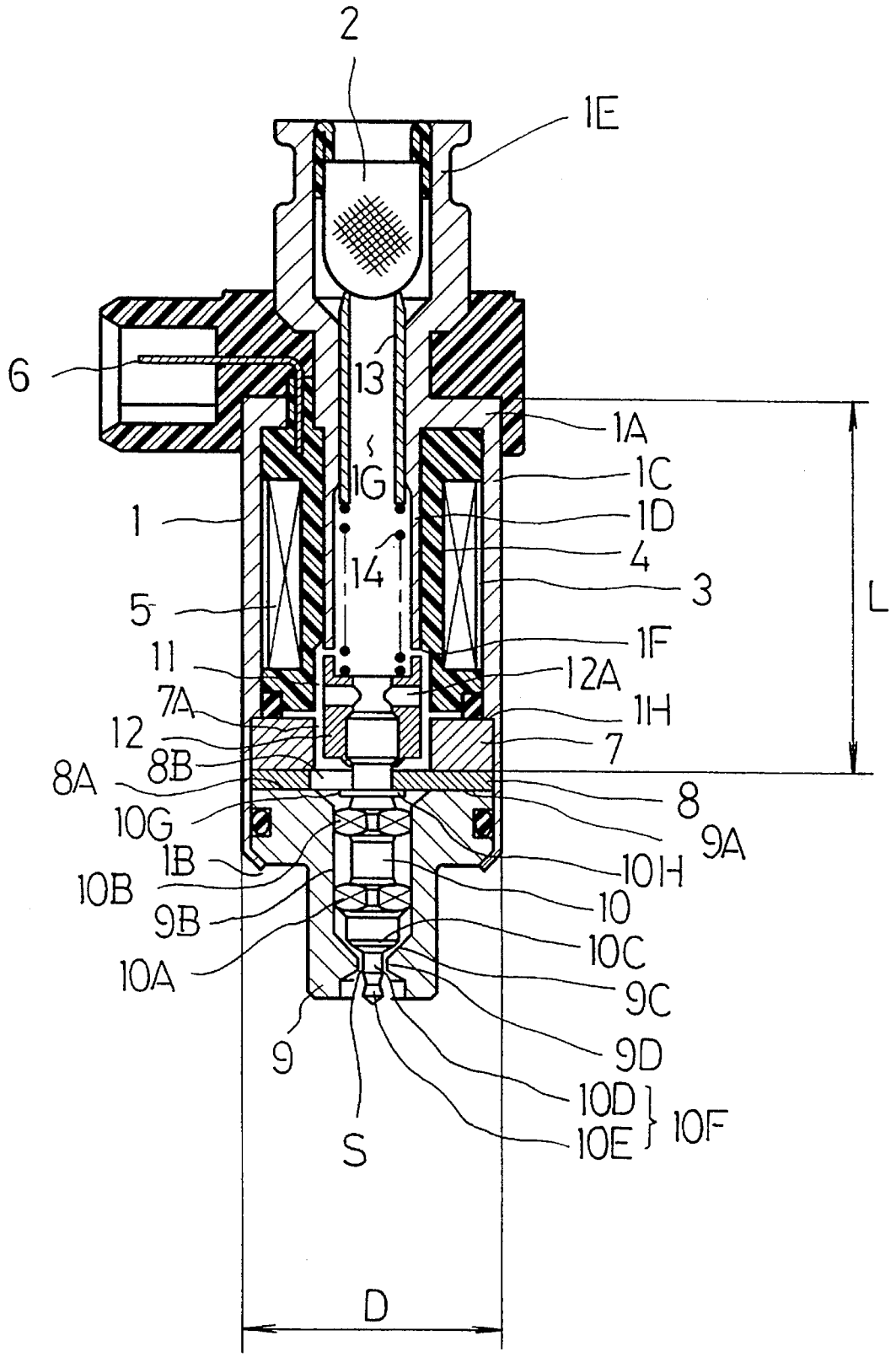
FIG. 1 is a longitudinal section of an electromagnetic type fuel injection valve according to one preferred embodiment of the present invention.
Figure 2:
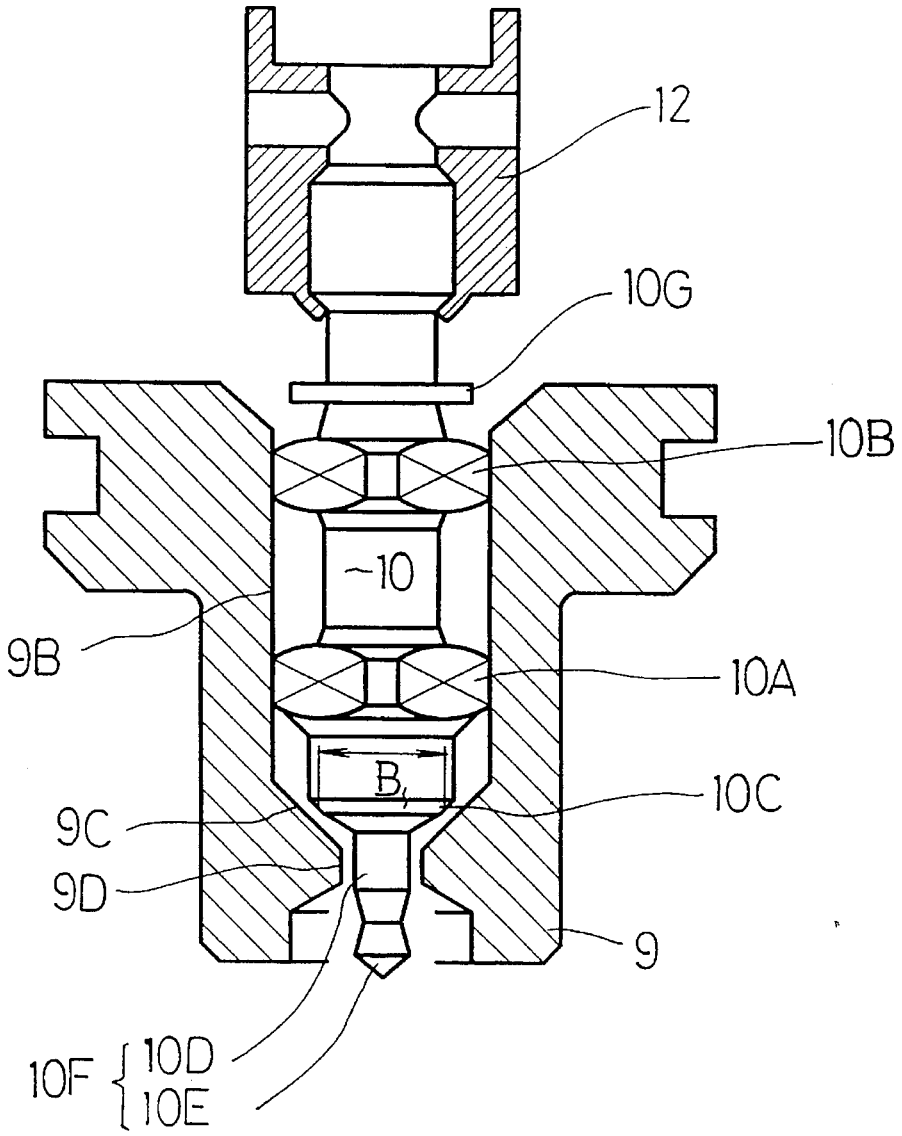
FIG. 2 is an enlarged longitudinal section of a valve seat-and-needle valve assembly used in the embodiment of FIG. 1.

Referring to FIGS. 1 and 2, there is shown an electromagnetic type fuel injection valve according to a first embodiment of the present invention. A cylindrical housing 1 has a stationary core 1D extending from its bottom 1A toward its opening end 1B (downward in the drawing), and a socket 1E extending from the bottom 1A on the opposite side (upward in the drawing). A fuel channel 1G is made through the whole length from the rear end of the socket 1E to the front end IF of the stationary core 1D, and a strainer 2 is positioned upstream of the fuel channel 1G.

A coil 5 is made by winding wire about an associated bobbin 4, and the coil 5 is positioned in the space 3 defined between the outer circumference of the stationary core 1D and the inner circumference of the housing 1. A terminal extension 6 projects sideward from the bottom 1A of the housing 1, and is connected to the coil 5. An electric current signal is applied to the coil 5 via the terminal extension 6.

The opening end 1B of the housing 1 has an annular engagement shoulder 1H for receiving an annular yoke 7, a stopper plate 8 and a valve seat piece 9 in the order named. These are fixedly held by bending and pressing the circumference edge of the opening end 1B against the enlarged base of the valve seat piece 9.

The valve seat piece 9 has a cylindrical guide hole 9B extending from its bottom surface 9A toward its front end. Also, the valve seat piece 9 has a converging valve seat 9C positioned consecutive to the cylindrical guide hole 9B to open at its tip end via a fuel metering-and-injecting aperture 9D.

A needle valve 10 is slidably fitted in the cylindrical guide hole 9B. The needle valve 10 has forward and rearward polygonal guide expansions 10A and 10B, a converging valve portion 10C, a straight rod portion 10D and a converging end 10E. The converging valve portion 10C is adapted to seat on the valve seat 9C to close the fuel metering-and-injecting aperture 9D. The straight rod portion 10D of the pintle 10F is put in the fuel gauging-and-injecting aperture 9D so that the effective fuel-injection area S is determined by the fuel metering-and-injecting aperture 9D and the straight rod portion 1OD.

On the other hand, the rear length of the needle valve 10 extends through the stopper plate 8 and the yoke 10 toward the inner circumference of the front end of the bobbin 4. A movable plunger 12 is put in the space defined by the inner circumference of the front end of the bobbin 4 and the inner circumference of the annular yoke 7, and the movable plunger 12 faces the end 1F of the stationary core 1D. The movable plunger 12 is fixed to the rear end of the needle valve 10.

The rear extension from the rearward polygonal guide expansion 10B has an annular collar 10G ahead of the movable plunger 12. The rear surface 10H of the annular collar 10G faces the front surface 8A of the stopper plate 8. Thus, the backward stroke of the needle valve 10 is limited when the rear surface 10H of the annular collar 10G abuts on the front surface 8A of the stopper plate 8.

A spring-adjusting pipe 13 is fitted in the fuel channel 1G to compress a spring 14 between the spring-adjusting pipe 13 and the movable plunger 12. Thus, the needle valve 10 is spring-biased in the forward direction.

When the coil 5 is not energized, the plunger-and-needle valve assembly is driven forward under the resilient influence of the spring 14 until the converging valve portion 10C abuts on the converging valve seat 9C of the valve seat piece 9. Thus, the fuel which is pumped in the fuel channel 1G is prevented from injecting from the metering-and-injecting aperture 9D.

When the coil 5 is energized, the magnetic flux passes through the magnetic path from the housing 1 to the stationary core 1D through the yoke 7 and the movable plunger 12 to pull the movable plunger 12 toward the front end 1F of the stationary core 1D against the resilient force of the spring 14. The backward stroke of the needle valve 10 is limited when the rear surface 10H of the annular collar 10G abuts on the front surface 8A of the stopper plate 8.

When the plunger-and-needle valve assembly is shifted toward the stationary core 1D, the converging valve portion 10C leaves the converging valve seat 9C of the valve seat piece 9, thereby opening the metering-and-injecting aperture 9D.

Then, the fuel which is pumped in the fuel channel 1G is allowed to pass through the cross apertures 12A of the movable plunger 12, the hole 7A of the annular yoke 7, the aperture 8B of the stopper plate 8, the gap between the hexiagonal guide expansions 10A and 10B of the needle valve 10 and the needle valve guide hole 9B, the gap between the valve seat 9C and the converging valve portion 10C, and the metering-and-injecting aperture 9D, finally injecting to the suction tube. The amount of the fuel which injects from the electromagnetic type of fuel injection valve can be measured by controlling the length of time for which electric current is allowed to flow in its coil.

Size-reduction of such electromagnetic type of fuel injection valves can be attained as follows. First, it should be noted that the factors of preventing size-reduction of such valves are:

1) the effective area S of the fuel metering-and-injecting aperture 9D, which corresponds to the annular space between the circumference of the fuel metering-and-injecting aperture 9D and the circumference of the straight rod portion 10D of the pintle 10F;

2) the passage area of the valve seat 9C formed in the valve seat piece 9;

3) the attractive force to pull the needle valve 10 toward the stationary core 1D against the fuel pressure; and 4) the operating speed of the needle valve 10 quick enough to follow the running of the gasoline engine.

Electromagnetic type fuel injection valves are actually designed to be used in mass-produced, four- and two-wheeled vehicles. Judging from their engine driving powers and from the number of the cylinders of such gasoline engines as used in these vehicles, the flow rate at which the fuel is injected from such fuel injection valves when fully opened is justly presumed to be 20 L/H.

In general, the pumping pressure at which a fuel pump drives fuel toward the fuel injection valve ranges from 2 $Kg/cm^2$ to 4 $Kg/cm^2$, and therefore, to obtain the maximum flow rate of 20 L/H it is necessary that the valve has a maximum effective injecting area of 0.3 $mm^2$. Stated otherwise, the gauging-and-injecting aperture of 0.3 $mm^2$ allows fuel to flow at the rate of 20 L/H, and therefore, a compact-designed valve need not have a larger gauging-and-injecting aperture.

As for the passage area of the valve seat 9C on the upstream side of the fuel metering-and-injecting aperture 9D it is necessary that the passage area is 0.3 $mm^2$ at its minimum. If the passage area is below 0.3 $mm^2$, it cannot be assured that the maximum flow rate of 20 L/H is obtained because of the throttling of fuel on the upstream side of the fuel metering-and-injecting aperture 9D.

Figure 3:
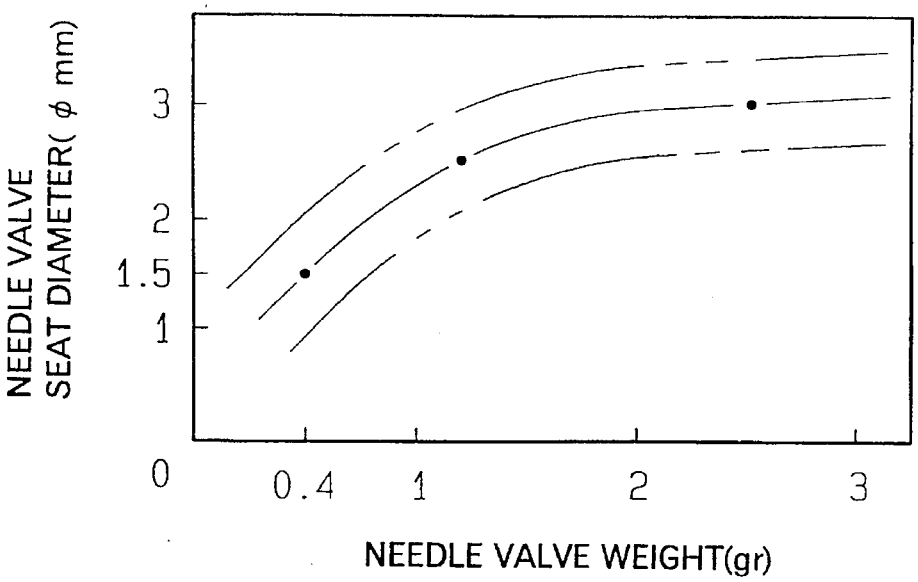
FIG. 3 shows the relation between the needle valve weight and the valve seat diameter.

The inventor made tests on plunger-guided type needle valves 10 (FIG. 2) of different shapes and materials to determine the limit of the size-reduction of the converging valve portion 10C of the needle valve 10 in terms of its diameter ϕB and the limit of the weight-reduction of the needle valve 10, which has a movable plunger 12 integrally connected to its rear end, and is adapted to be guided reciprocally in the cylindrical guide hole 9B. The test results are shown in FIG. 3.

As seen from this graphic representation, the manufacturing limit of a smallest diameter valve portion 10C is about 1.5 mm in diameter whereas the manufacturing limit of a lightest weight of needle valve 10 is about: 0.4 gr. No dimensional accuracy can be assured below these limits in manufacturing needle valves; the mass-production of needle valves would be prevented because of the increasing of injected ones.

Figure 4:
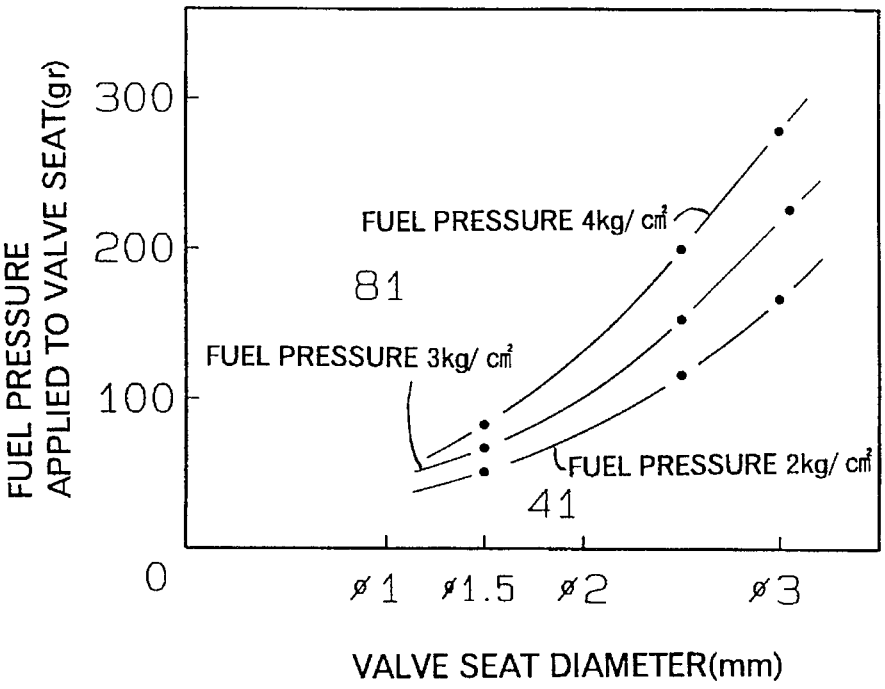
FIG. 4 shows the relation between the valve seat diameter and the fuel pressure applied to the valve seat.

Fuel pressures applied to the valve seat 9C are found for a converging valve portion 10C of 1.5 mm in diameter (ϕB) in FIG. 4. Specifically, for the pumped fuel pressure of 2 $Kg/cm^2$ the fuel pressure applied to the valve seat 9C is 41 gr. whereas for the pumped fuel pressure of 4 $Kg/cm^2$ the fuel pressure applied to the valve seat 9C is 81 gr.

In consideration of those described above the attractive force to pull the needle valve 10 toward the stationary more 1D man be determined as follows:

1) the weight limit of the needle valve 10 is 0.4 gr., and the minimum weight of the needle valve 10 which is permissible from the point of manufacturing view is 0.5 gr.

The electromagnetic type fuel injection valve is supposed to be subjected to a maximum gravity acceleration of 50G momentarily by the vibration of the running gasoline engine. To assure the stable operation of the needle valve in this strict condition it is necessary to load the needle valve with a 38-gram heavy loading spring 14.

The resilient load of 38 grams is determined by:

0.5 gr.(weight of the needle valve)×50G (gravity acceleration)×1.5 (safety coefficient)=38 gr.

The spring 14 is adapted to push the needle valve 10 against the valve seat 9C of the valve seat piece 9.

2) The spring 14 is capable of adjustably loading the needle valve 10 within a variable range from +90 gr. to −90 gr. (that is, the resilient force being adjustable within the range of 180 gr.) so that the flow rate at which fuel flows out from the gauging-and-injecting aperture 9D may be controlled within the relatively low flow rate range.

3) As for gasoline engines which mass-produced vehicles are equipped with, the maximum rotation speed of such gasoline engines is 10,000 RPM, and the period is 12 mSec. To keep pace with this speed the electromagnetic type of fuel injection valve 10 needs at least 2-milli second quick response. To obtain the 2-milli second quick response the needle valve requires a loading of about 3 gr. in running.

From the above the attractive force to pull the needle valve 10 is determined to be 221 gr., which is a total of: 38 gr.(the setting load of the spring 14)+180 gr.(the adjustable range of the spring 14)+3 gr.(the operating load to the needle valve 10).

Figure 5:
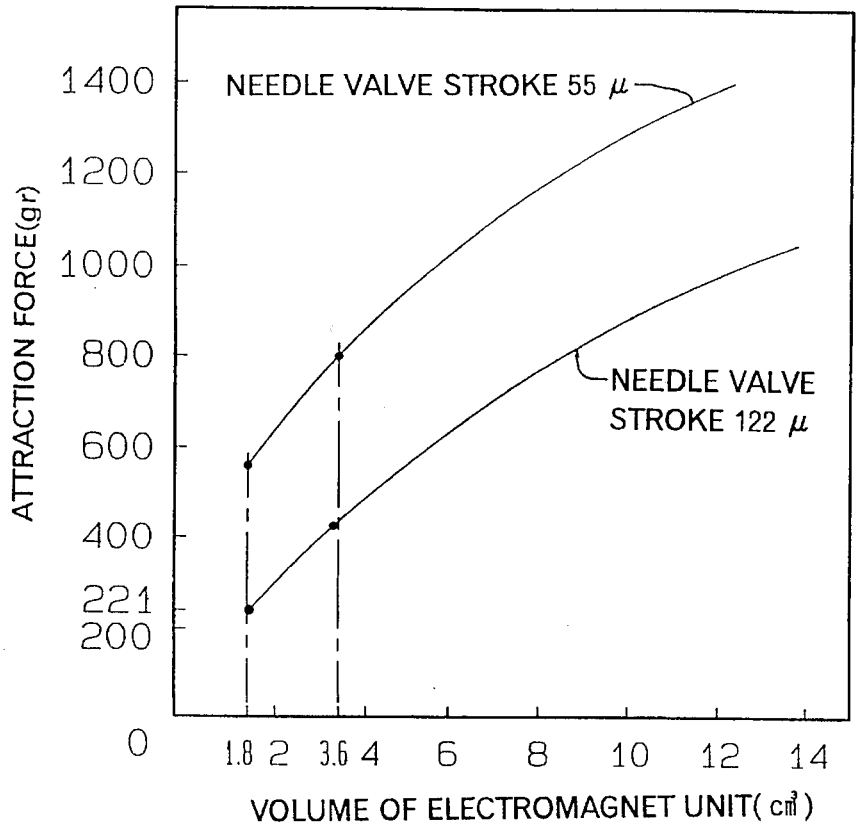
FIG. 5 shows the relation between the volume of the electromagnet unit and the attraction force thereof.
Figure 6:
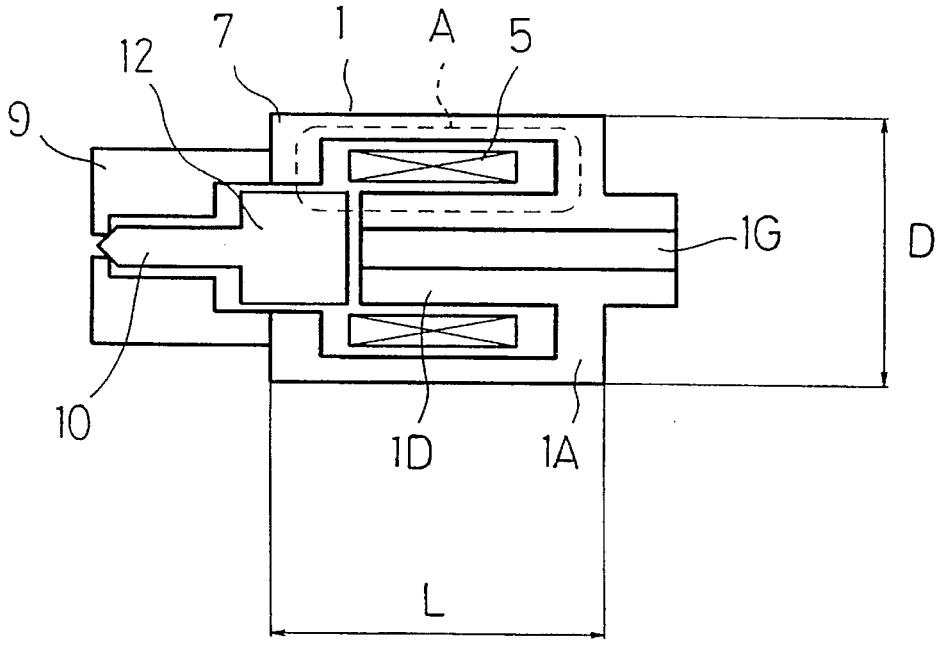
FIG. 6 shows diagramatically in longitudinal section, the electromagnetic type of fuel injection valve of FIG. 1.

FIG. 5 shows how the attractive force (gr.) produced by the electromagnet varies with the volume of the electromagnet ($cm^3$). The volume of the electromagnet ($cm^3$) can be given by particular dimensions as shown in FIG. 6. Specifically, the magnetic path A in the electromagnet is given by the bottom 1A and cylindrical wall 1C of the cylinder housing 1, the yoke 7, the movable plunger 12 and the stationary core 1D. The volume of the electromagnet ($cm^3$) is given by the longitudinal length L of the magnetic path A and the outer diameter D of the housing 1, crossing the longitudinal length L. The attractive force (gr.) increases with the increase of the volume of the electromagnet ($cm^3$).

As described earlier, the attractive force required for a needle valve 10 having a movable plunger 12 integrally connected thereto is 221 gr., and the corresponding volume of the electromagnet is found to be 1.8 $cm^3$ from the test results given in FIG. 5.

In consideration of the valve manufacturing allowance, the selection of materials and other manufacturing factors the volume of the electromagnet ($cm^3$) may preferably range from 1.8 to 3.6 $cm^3$ (safety coefficient doubled). For examples, the magnetic path A in the electromagnet of 1.8 $cm^3$ has a longitudinal length L of 13.6 mm and an outer diameter D of 13 mm, and the magnetic path A in the electromagnet of 3.6 $cm^3$ has a longitudinal length L of 23.4 mm and an outer diameter D of 14 mm.

The forward stroke of a needle valve 10 is determined to be 122 μ from the diameter of the valve portion 1OC (1.5 mm) and the maximum passage area of the valve seat 9C (0.3 $mm^2$) and in consideration of the converging shapes of the valve portion 10C and valve seat 9C.

The backward stroke of the needle valve 10 is determined to be 55 μ from the opening of the strainer 2 (30 μ).

As may be understood from the above, the major valve part, which is a decisive factor for determining the whole size of the electromagnetic type of fuel injection valve, can be designed to be compact as a result of decision of volume L×D ranging from 1.8 to 3.6 $cm^3$, where L stands for the longitudinal length of the magnetic path, and D stands for the outer diameter crossing the longitudinal length.

The compact designing of electromagnetic type valves expands use of such valves in vehicles having a relatively small engine space, particularly two-wheeled vehicles. Also, such compact electromagnet type valves can be fixed to a multi-suction engine having a plurality of suction valves around a single cylinder with each electromagnet type valve directed to the counter suction valve.

Figure 8:
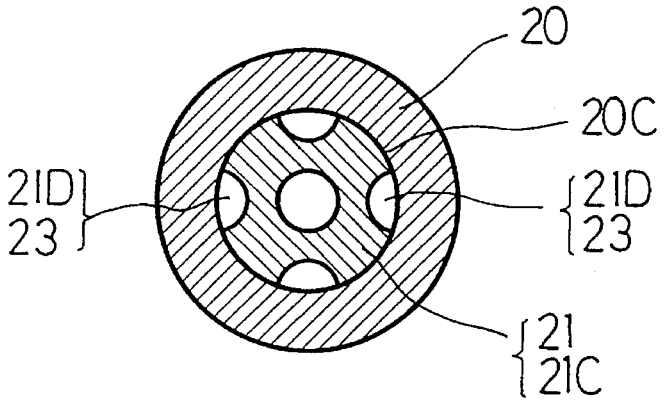
FIG. 8 is a cross section of the fuel injection valve taken along the line 8—8 in FIG. 7.
Figure 7:
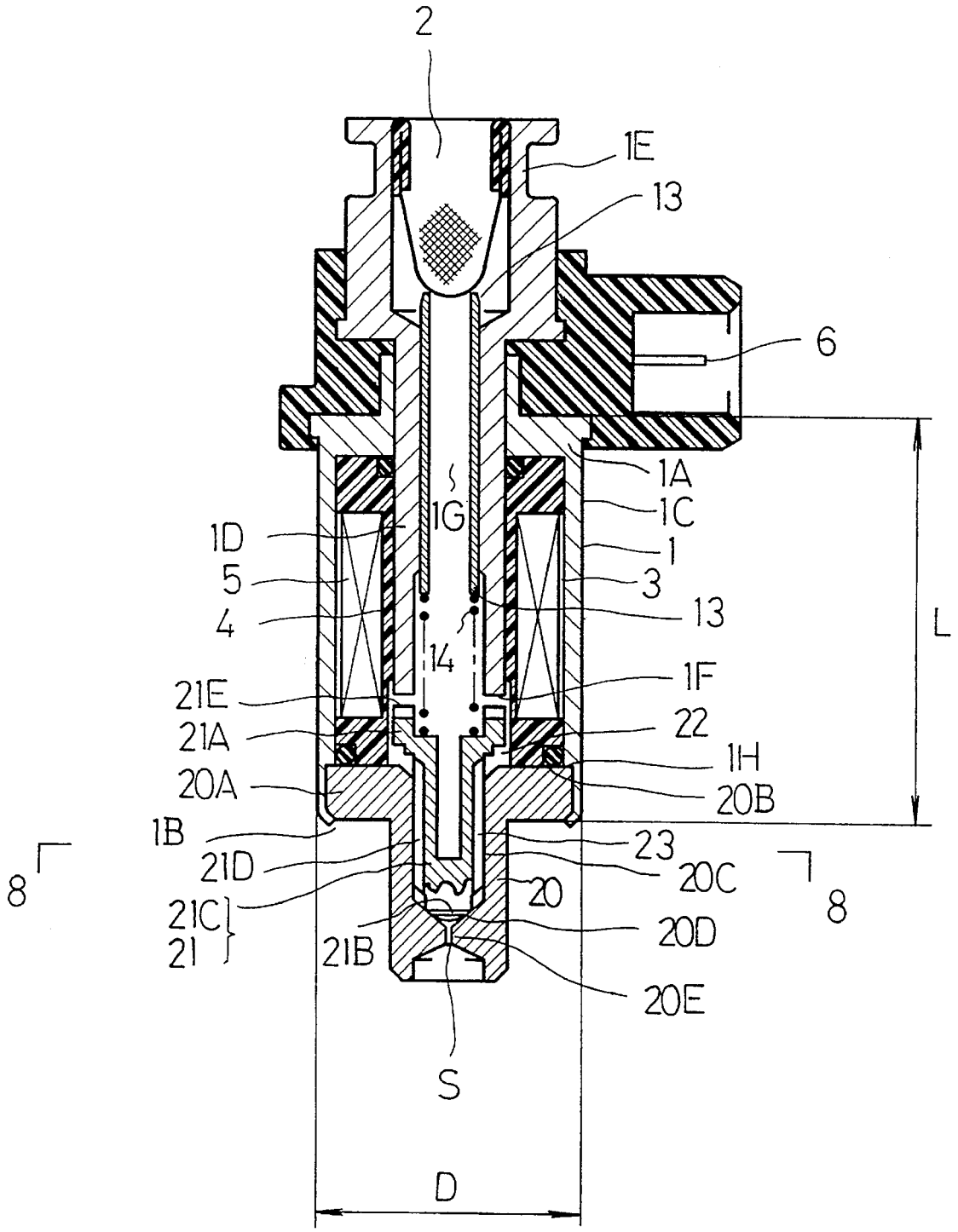
FIG. 7 is a longitudinal section of an electromagnetic type of fuel injection valve according to a second embodiment of the present invention.

Referring to FIGS. 7 and 8, an electromagnetic type fuel injection valve according to the second embodiment of the present invention is described. In these drawings same parts as appear in FIG. 1 are indicated by same reference numerals as used in FIG. 1.

The electromagnetic type fuel injection valve is different from FIG. 1 in that: the yoke and the stopper plate are omitted in FIG. 7, and a needle valve-and-plunger assembly and a valve seat piece are different in structure from FIG. 1.

The valve seat piece 20 has an annular yoke 20A press-fitted in the engagement shoulder 1H of the end of the housing 1, and a needle guide hole 20C extends from the rear side 20B of the annular yoke 20A towards the front end of the valve seat piece 20. The needle guide hole 20C ends with the converging valve seat 20D, and a fuel metering-and-injecting aperture 20E is consecutive to the converging valve seat 20D.

As seen from FIG. 7, the annular yoke 20A is fixed to the housing 1 by press-fitting the yoke 20A in the engagement shoulder 1H of the end of the housing 1 and by bending and pressing the circumference edge of the housing end over the yoke 20A.

A needle valve 21 has a cylindrical plunger 21A integrally connected to its rear end, and a converging valve end 21*b* formed at its front end, which converging valve end 21*b* is adapted to sit on the valve seat 20D of the valve seat piece 20. The cylindrical plunger 21A and the converging valve end 21*b*, and the intervening guide rod 21C are integrally connected, and are made in the form of a single element.

As best seen from FIG. 8, a plurality of fuel channels 21D (four channels in this particular example) are made longitudinally on the outer circumference of the guide rod 21C.

The guide rod 21C of the needle valve 21 is movably fitted in the guide hole 20C of the valve seat piece 20, and the plunger 21A of the needle valve 21 is movably fitted in the space 22 defined by the inner circumference of the coil bobbin 4. Thus, the rear end surface 21E of the plunger 21A faces the front end 1F of the stationary core 1D, and the fuel passages 23 are formed by the fuel channels 21B of the outer circumference of the guide rod 21C and the inner circumference of the guide hole 20C of the valve seat piece 20.

When the coil 5 is not energized, the needle valve 21 is resiliently driven forward until the valve end 21*b* abuts on the valve seat 20D, thus preventing the fuel pumped into the fuel channels 1G and 23 from injecting from the fuel metering-and-injecting aperture 20E.

When the coil 5 is energized, the magnetic flux passes through the housing 1, the yoke 20A, the plunger 21A and the stationary core 1D, thus pulling the needle valve 21 toward the end 1F of the stationary core 1D, overcoming the counter resilient force of the spring 14. The needle valve 21 stops at the end of the backward stroke where the rear end surface 21E of the plunger 21A abuts on the front end 1F of the stationary core 1D. Then, the valve end 21B of the needle valve 21 leaves the valve seat 20D, thereby opening the fuel metering-and-injecting aperture 20E.

Thus, the fuel pumped in the fuel channel 1G passes through the space 22 defined between the outer circumference of the plunger 21A and the inner circumference of the coil bobbin, the fuel channel 23, the annular space defined between the valve end 21B and the valve seat 20D and the fuel metering-and-injecting aperture 20E, finally injecting to the suction tube.

Different from the needle valve of FIG. 1, the needle valve 21 of FIG. 1 has no pintie 1OF, and therefore, the effective fuel-injecting area S is equal to the size of the fuel metering-and-injecting aperture 20.

An electromagnetic type of fuel injection valve according to the second embodiment can be compactly designed, provided that the product of L (the longitudinal length of the magnetic path)×D (the outer diameter crossing the longitudinal length) remains within the range from 1.8 to 3.6 $cm^3$, as is the case with an electromagnetic type of fuel injection valve according to the first embodiment.

The longitudinal length of the needle valve of the second embodiment can be substantially reduced by the following factors:

(1) the plunger 21A is formed as a part of the needle valve 21, and therefore, no extra space is required for connecting a separate plunger to the needle valve as in FIG. 1;

(2) the backward stroke of the needle valve 21 toward the stationary core 1D is limited by allowing the rear surface 21E of the plunger 21A to abut on the front end IF of the stationary core, resulting in the omitting of the annular collar lOG and the stopper plate 8 in FIG. 1; and (3) the valve seat piece 20 has a yoke 20A in the form of annular collar at its rear end, resulting in the omitting of the separate yoke 7 in FIG. 1.

The scope of the present invention should not be understood as being restrictive to the embodiments described above because the present invention can be embodied in different modes without departing the spirit of the present invention.

What is claimed is:

1. An electromagnetic type fuel injection valve comprising:

a cylindrical housing having an opened tip end, a bottom and a stationary core extending from said bottom toward said opened tip end;

an annular yoke positioned in a vicinity of the opened tip end of the housing, and magnetically coupling with the housing 1;

a coil positioned in a space defined by the housing, the stationary core and the yoke;

a valve seat piece formed with a valve seat arranged at a tip end side of said yoke and to be opened and closed by a valve portion formed at a tip end of a needle valve and a metering-and-injecting aperture continuous with said valve seat and opening toward said opened tip end; and a movable plunger located at a rear end of the needle valve and opposing to a tip end of the stationary core, a flow rate at which a fuel is injected from the fuel injection valve when fully opened is 20 L/H with the fuel metering-and-injection aperture having a maximum effective injection area of 0.3 $mm^2$; and a product (L×D) of a longitudinal length (L) of a magnetic path formed by the housing and the yoke and a diameter D crossing the longitudinal length L ranging from 1.8 $cm^3$ to 3.6 $cm^3$.

2. An electromagnetic type fuel injection valve according to claim 1 wherein the needle valve comprises an integral connection of a valve end, a guide rod and a plunger, the integral connection being made in a single unit piece, the valve end being adapted to open and close the fuel metering-and-injection aperture of the valve seat, the guide rod being fitted in a guide hole of the valve seat piece, and the guide rod having fuel channels formed on a circumference thereof to allow the fuel to flow down toward the valve seat, and the plunger opposing to the tip end of the stationary core.

3. An electromagnetic type fuel injection valve according to claim 1 wherein the valve seat piece has an annular enlargement to be fitted in and fixedly aught by a terminal engagement portion of the housing; and the valve seat piece has a guide hole extending through an entire length thereof from a rear end surface to the valve seat.

4. An electromagnetic type fuel injection valve according to claim 1, wherein said valve seat is integrally formed with said yoke engaging with an engaging shoulder portion formed in the vicinity of the opened tip end of said housing, at the rear end thereof, and a needle valve guide hole being formed from the rear end surface of said yoke to said valve seat located in the vicinity of the opened tip end.

5. An electromagnetic type fuel injection valve comprising:

a bottomed cylindrical housing having an opened tip end and a stationary core extended from the center of a bottom portion toward said opened tip end;

a yoke arranged in a vicinity of said opened tip end of said housing and magnetically coupled with said housing;

a coil arranged within a space defined by said housing, said stationary core and said yoke;

a valve seat assembly arranged at a tip end side of said yoke and having a valve seat opened and closed by a valve portion formed at a tip end of a needle valve and a fuel metering aperture continuous with said valve seat and opening toward said open tip end of said housing;

a movable plunger located at a rear end of said needle valve and being arranged in opposition to a tip end of said stationary core;

a fuel flow rate to be injected at fully open position being 20 L/H and an effective opening area of said fuel metering aperture S being 0.3 $mm^2$ at the maximum, and a product (L×D) of a longitudinal length L of a magnetic path defined by said housing and outer periphery of said yoke and an external diameter D perpendicular to said longitudinal axis being in a range of 1.8 $cm^3$ to 3.6 $cm^3$.

6. An electromagnetic type fuel injection valve according to claim 5, wherein said needle valve includes said valve portion at the tip end for opening and closing said valve seat, and said movable plunger located at the rear end and opposing to the tip end of said stationary core, said valve portion and said movable plunger being connected to each other, a guide rod which is guidingly disposed within a needle valve guide hole of said valve seat, is formed with a fuel passage groove for flowing a fuel introduced into said needle valve guide hole toward said valve seat, and said guide rod being integrally formed with said valve portion, said movable plunger and said fuel passage groove as a single member.

* * * * *